United States Patent [19]

Wittmann et al.

[11] Patent Number: 4,636,413

[45] Date of Patent: Jan. 13, 1987

[54] CORNER GLASS BLOCK

[75] Inventors: Bernd Wittmann, Montabaur; Eberhard Hayn, Dernbach, both of Fed. Rep. of Germany

[73] Assignee: Westerwald AG für Silikatindustrie, Fed. Rep. of Germany

[21] Appl. No.: 807,505

[22] Filed: Dec. 11, 1985

[30] Foreign Application Priority Data

Dec. 18, 1984 [DE] Fed. Rep. of Germany ..... 8437071

[51] Int. Cl.[4] ..... E04C 1/42

[52] U.S. Cl. ..... 428/33; 52/306; 52/316; 428/192; 428/426

[58] Field of Search ..... 52/272, 277, 306, 284; 446/122, 127; 428/33, 192, 426, 542.8

[56] References Cited

U.S. PATENT DOCUMENTS

| | | | |
|---|---|---|---|
| 1,294,446 | 2/1919 | Greenstreet | 428/33 X |
| 2,102,149 | 12/1937 | Guthrie | 52/306 |
| 2,112,241 | 3/1938 | Hyde | 52/306 X |
| 2,281,524 | 4/1942 | Meyers | 52/284 X |
| 3,271,232 | 9/1966 | Moore | 428/192 X |
| 3,959,541 | 5/1976 | King et al. | 428/25 X |
| 4,023,319 | 5/1977 | Kurata | 52/308 |
| 4,058,943 | 11/1977 | Sturgill | 428/53 X |
| 4,326,012 | 4/1982 | Charlton | 52/306 X |
| 4,537,001 | 8/1985 | Uppstrom | 428/33 X |
| 4,551,364 | 11/1985 | Davies | 428/33 X |

*Primary Examiner*—Henry F. Epstein

*Attorney, Agent, or Firm*—Webb, Burden, Robinson & Webb

[57] ABSTRACT

A glass block has at least approximately the shape of a sector of a circular cylinder, the side faces forming the sector of the circular cylinder and containing the axis of the cylinder, preferably including an angle of 45° or 90°. The side faces defining the sector of the cylinder and containing the axis of the cylinder are formed with a recess to take up mortar, cement or the like used in bricklaying a wall made of glass blocks.

4 Claims, 2 Drawing Figures

CORNER GLASS BLOCK

BACKGROUND OF THE INVENTION

1. Field of the Invention

The invention relates to a glass block.

2. Brief Description of the Prior Art

It is conventional to use a metal or wooden post as the connecting edge of two walls laid, for instance, of parallelepipedal glass blocks and to be joined at right or obtuse angles. The post also may form part of a frame in which the glass block walls are set.

It is also conventional to interconnect two glass block walls such that the gap at the connecting edges is filled with concrete.

Both the use of a post of metal or wood as well as pouring concrete into the gap have the disadvantage of interrupting the transparency of the glass block wall in the area of the corner whereby the overall aesthetic effect of the glass block wall is disturbed in the corner.

It is, therefore, an object of the invention to provide a glass block by the use of which glass block walls may be made transparent also in the areas of corners and the abutting glass block walls may be given a uniform appearance also in the corner region.

SUMMARY OF THE INVENTION

The glass block according to the invention has at least approximately the shape of a sector of a circular cylinder, the side faces forming the sector of the circular cylinder and containing an axis defined by the side faces of the cylinder including an angle of 45° or 90°.

To make a 90° corner joint, the glass block is so designed that the side faces defining the sector of the circular cylinder and containing the axis of the cylinder are disposed at an angle of 90° with respect to each other.

It it is stated above and hereinafter that the side faces of the glass block contain the axis of the cylinder, this is to be understood as implying that the planes defined by the side faces contain the axis of the cylinder. The side face itself need not necessarily in each case reach as far as the axis of the cylinder.

Assuming for example that eight glass block walls are to be joined in the form of an equilateral octagon, the glass blocks according to the invention are so designed that the side faces delimiting the sector of the circular cylinder and containing the cylinder axis include an angle of 45°.

In a preferred modification of the glass block according to the invention, recesses are formed in the side faces so that mortar used in bricklaying the wall of glass blocks will cause the least disturbance of the glass-like appearance of the wall. These recesses extend vertically between the end faces of the glass block, are continuous, and interrupt the edges thereof which intersect the cylinder axis.

Firm anchoring of the corner glass block according to the invention in the wall is promoted by straight grooves formed in the side faces and/or curved grooves, e.g. of the configuration of segments of circular rings formed in the end faces and adapted to receive respective reinforcing members embedded in suitable mortar. The reinforcing members thus extend both horizontally and vertically between the glass blocks.

Preferably the glass block according to the invention is made of pressed glass.

BRIEF DESCRIPTION OF THE DRAWINGS

A glass block according to the invention will be described further below, with reference to the accompanying drawings, in which.

DETAILED DESCRIPTION OF THE INVENTION

Figure 1:
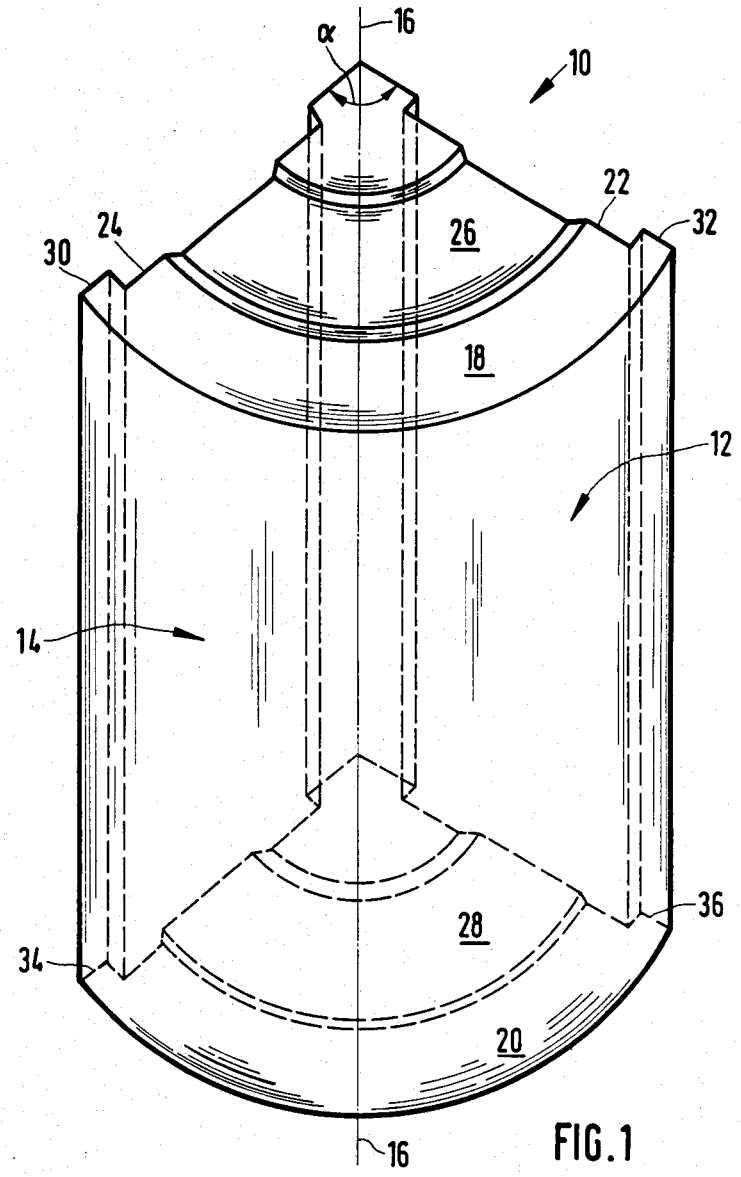
FIG. 1 is a perspective view of a glass block.

As shown in FIG. 1, the glass block 10 which is suitable for a corner joint comprises two side faces 12, 14 which contain the axis 16 of the cylinder from which the shape of the glass block 10 is derived. In the embodiment shown in angle $\alpha$ between the side faces 12 and 14 is 90°.

Recesses 22 and 24 are formed in the side faces 12 and 14, respectively, of the glass block 10 and extend vertically between the end faces 18 and 20. In this manner the visible joints in the wall made of glass blocks are narrow in spite of ample use of mortar and reinforcing steel. Furthermore, the provision of recesses supports the anchoring of the glass blocks.

Figure 2:
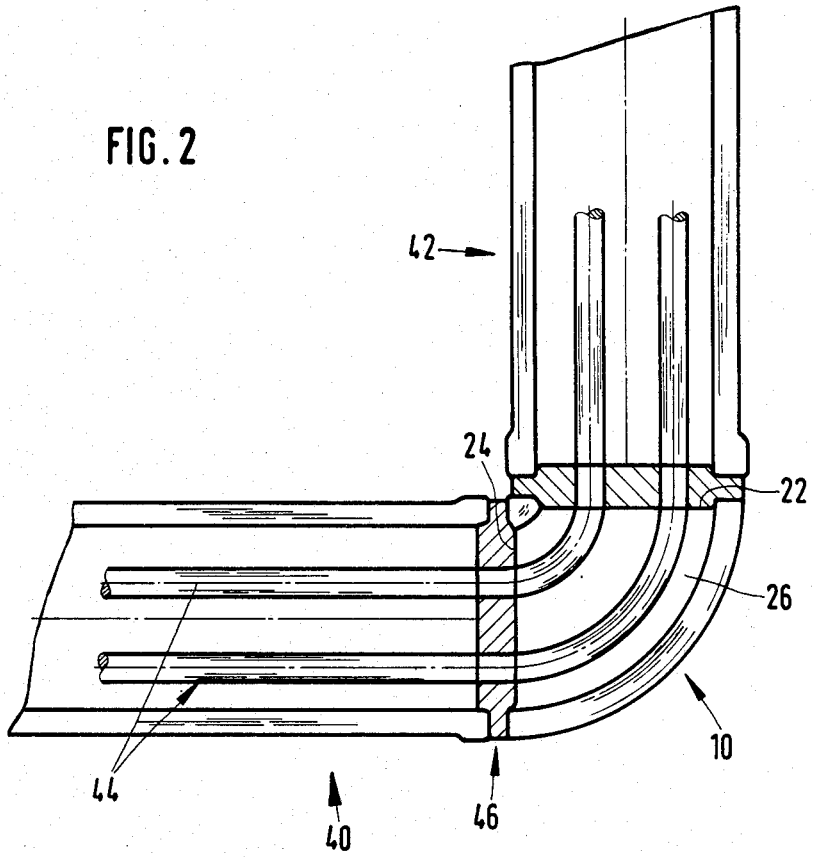
FIG. 2 is a horizontal section of a corner joint formed by the glass block.

A groove 26 or 28 of the shape of a segment of a circular ring is formed in the end faces 18, 20 of the glass block 10. Not only the recesses 22, 24 provided in the side faces but also the grooves formed in the end faces register with the edges 30, 32, 34, 36 of the glass block 10. The groove 26, 28 serves to receive steel reinforcements as shown in FIG. 2. Additional reinforcing steel may be positioned also in the groove 22, 24 if this should be required for reasons of statics.

FIG. 2 shows a horizontal section of a corner joint of glass walls made by use of a glass block 10 in accordance with FIG. 1. Parallelepipedal glass blocks 40, 42 abut each other at an angle of 90°. The glass block 10 fills the connection at the corner. For safe anchoring of the glass block 10 constituting the corner, one or two steel reinforcements 44 are laid in mortar in the respective groove 26. FIG. 2 also illustrates how the recesses 22, 24 formed in the side faces of the glass block 10 help to keep the joints 46 narrow. Moreover, steel reinforcements (not shown in the Fig.) may be positioned in the recesses 22, 24. These vertically extending steel reinforcements are positioned between the horizontally extending steel reinforcements 44 during installation. This guarantees especially stable anchoring. Furthermore, the intersecting means of reinforcement each may be provided with bores or slots so that they may be engaged in form lock with one another upon installation.

Having described presently preferred embodiments of our invention, it is to be understood that it may otherwise be embodied within the scope of the appended claims.

What is claimed is:

1. A glass block having two side faces forming at least approximately the shape of a sector of a circular cylinder and containing the axis of the cylinder, both side faces being formed with a recess, the side faces terminating in end faces, each recess extending vertically between the end faces of the glass block for receiving mortar or the like, the side faces interrupting edges of the end faces which are formed with recesses adapted to receive reinforcing members.

2. The glass block as claimed in claim 1, wherein the side faces forming the sector of the circular cylinder and containing the axis of the cylinder include an angle of 90°.

3. The glass block as claimed in claim 1, wherein the side faces forming the sector of the circular cylinder and containing the axis of the cylinder include an angle of 45°.

4. The glass block as claimed in claim 1 formed of pressed glass.

* * * * *